US007644766B2

(12) United States Patent
Begley et al.

(10) Patent No.: US 7,644,766 B2
(45) Date of Patent: Jan. 12, 2010

(54) FLUSHING DEVICE AND METHOD OF FLUSHING AN ANNULAR SPACE

(75) Inventors: Maxwell Graham Begley, Malaga (AU); Keith Munslow-Davies, Perth (AU)

(73) Assignee: Drilling Solutions Pty Ltd, Malaga, Western Australia (AU)

( * ) Notice: Subject to any disclaimer, the term of this patent is extended or adjusted under 35 U.S.C. 154(b) by 405 days.

(21) Appl. No.: 10/555,367

(22) PCT Filed: May 3, 2004

(86) PCT No.: PCT/AU2004/000573

§ 371 (c)(1),
(2), (4) Date: Oct. 10, 2006

(87) PCT Pub. No.: WO2004/097165

PCT Pub. Date: Nov. 11, 2005

(65) Prior Publication Data

US 2007/0151737 A1 Jul. 5, 2007

(30) Foreign Application Priority Data

May 2, 2003 (AU) ..... 2003902106

(51) Int. Cl.
*E21B 21/10* (2006.01)

(52) U.S. Cl. ..... 166/312; 166/386; 166/334.4; 175/317

(58) Field of Classification Search ..... 166/312, 166/383, 323, 334.4, 374, 386; 175/38, 317
See application file for complete search history.

(56) References Cited

U.S. PATENT DOCUMENTS 4,176,717 A * 12/1979 Hix ..... 166/289
5,564,500 A 10/1996 Rogers et al.

(Continued)

FOREIGN PATENT DOCUMENTS

GB 2351511 A 1/2001

(Continued)

*Primary Examiner*—David J Bagnell
*Assistant Examiner*—David Andrews
(74) *Attorney, Agent, or Firm*—Harness, Dickey & Pierce, P.L.C.

(57) ABSTRACT

A flushing device (20) comprising an inner sleeve (21), axially slidable relative to an outer sleeve (23). The inner (21) and outer (23) sleeves cooperate to define an inner passage (32) for the flow of a fluid, and are permanently coupled such that there is substantially no rotational movement between the two sleeves. The inner passage (32) has an inlet (22*b*) and an outlet (22*a*). The outer sleeve (23) has a plurality of flushing outlets (33) which, when the flushing device (20) is in an open condition allow fluid to be diverted from the inner passage (32). The flushing device (20) also comprises an indexing mechanism (80) which indexes between a first position, wherein the plurality of flushing outlets (33) are blocked from the internal passage (32) such that the flushing device (20) is in a closed condition, to a second position, wherein the plurality of flushing outlets (33) register with the internal passage (32) such that the flushing device (20) is in the open condition. When fluid flows through the flushing device (20), the flushing device (20) is configured such that it remains in the selected open or closed condition regardless of the forces acting thereupon.

32 Claims, 11 Drawing Sheets

U.S. PATENT DOCUMENTS 5,730,222 A * 3/1998 Rike, Jr. ..... 166/373
5,901,796 A * 5/1999 McDonald ..... 175/57
6,173,795 B1 * 1/2001 McGarian et al. ..... 175/231
6,513,595 B1 * 2/2003 Freiheit et al. ..... 166/332.4
6,899,179 B2 * 5/2005 McGarian et al. ..... 166/332.2

FOREIGN PATENT DOCUMENTS

WO WO 97/14868 A 4/1997

* cited by examiner 151
54
51
71
61b
59
90
56
55
57
58
60
50a
61
61a
34
150
49
50

Flg 10

(a) (b) (c)

FLUSHING DEVICE AND METHOD OF FLUSHING AN ANNULAR SPACE

FIELD OF THE INVENTION

The present invention generally relates to a flushing device for use in conjunction with a drilling head for the drilling of subsurface holes and wells. In particular the invention relates to a flushing device which assists in maintaining suitable conditions for a drill head to operate efficiently.

BACKGROUND ART

As well paths in exploration and extraction activities in the oil and gas industries become increasingly longer and the network more complicated, new challenges are constantly faced in the area of well boring. One of these challenges is in respect of maintaining suitable conditions for the operation of the drill head or bit to cut through the medium.

When drilling well bores, a slurry, used to operate the drill head, is pumped from the surface through a drill stem assembly to the drill head. Upon reaching the end of the bore the slurry is caused to return to the surface, passing through the annular space between the sidewalls of the bore and the drill stem assembly before reaching the surface. The returning slurry suspends the cuttings made during the drilling process, transporting them back to the surface. The removal of the cuttings ensures the bore remains relatively clear, providing the drilling process with optimal conditions. Failure to remove the cuttings, or a suitable percentage of the cuttings, can cause equipment failure, resulting in costly down time and may even result in the equipment being irretrievable.

A build up of cuttings may result due to a reduction in the flow of slurry to and from the drill head, it may place unnecessary loads on the drill head and stem assembly, and may also cause the drill head to be wedged or jammed in the bore. Furthermore, with the increase in use of horizontal bores in well networks, a build up of cuttings on the lowermost, or bottom surface of the bore may cause side displacement of the drill head, resulting in the bore being drilled in a new and incorrect direction.

Several areas of the drilling process have been analysed and improvements have been made which enhance the process of returning the cuttings to the surface. These solutions have included improvements to the slurry composition used to drive the drill head, as well as improvements to the actual drill head and the speed in which it may operate. However, improvements are still required in order to increase and improve the removal of cuttings from the bore.

Increasing the flow rate of the slurry and hence the return rate of the slurry to the surface does not sufficiently solve the problem. Owing to the narrow gap of the annular space, cuttings still tend to collect in this area. This not only inhibits the drilling process but is also problematic when introducing pipe linings. Also, during subsequent cementing, additional problems are experienced if the hole is not relatively clear.

Several mechanical flushing devices have been developed to assist in the clearing of the cuttings. These devices are incorporated with the drill stem assembly and, typically, when in a closed condition, allow the passage of the slurry to pass therethrough before proceeding to the drill head. When required the flushing device is caused to move to an open condition. In this condition a percentage of the slurry is diverted from the main flow passage through ports located on the outside of the flushing device and passes into the annular space between the flushing device and the bore wall. The flushing device is remotely operated from the surface and typically requires the surface pumps to be switched off before the condition of the flushing device may be changed.

As the annular space between the drill stem assembly and the bore wall is particularly narrow, it is often the cause of packing or wedging of cuttings in this region. It is therefore highly desirable to keep this region clear. Hence, diverting a portion of the fluid as it passes through the flushing member to the annular space assists in flushing this area and maintaining a clear passage for the flow of return fluid and cuttings to the surface.

Several of these flushing devices are referred to in U.S. Pat. No. 6,161,632. The invention disclosed in U.S. Pat. No. 6,161,632 provides a flushing device which remains in a closed state by the weight of the drill stem acting downwardly thereupon. Relieving this weight by applying a pulling force upon the drill stem results in the flushing device moving to an open state, allowing a predetermined percentage of the slurry to be diverted from the main passage into the annular space. The slurry continues to be diverted for as long as the weight of the drill stem assembly has been relieved.

Subsequent, to the return of the weight loading, the ports close and the full flow of the slurry is again delivered to the drill head allowing the drilling process to continue.

Hence, in order to maintain the flushing device in a closed state a compressive force must be maintained upon the flushing device. Similarly, in order to maintain the flushing device in an open state a tractive force must be maintained upon the flushing device. If the compressive or tractive force is not constantly applied to the flushing device, the flushing device may automatically, and undesirably move to the alternate condition.

An outer valve part and inner valve part of the flushing device disclosed in U.S. Pat. No. 6,161,632 are connected in permanent rotation via key and keyway slots between the valve parts. The manner in which these parts are coupled together result in high concentrations of forces at this junction. These concentrations often lead to failures at this interface, requiring costly repairs to be made.

A further deficiency in this device is in relation to the bleed holes located on the outer wall of the tool. These bleed holes allow cuttings to ingress into the flushing device, contaminating the various parts within the flushing device, which may result in tool failure.

Another type of flushing device currently available overcomes some of the deficiencies of the device disclosed in U.S. Pat. No. 6,161,632 in that a tractive force does not need to be maintained upon the device in order for it to remain open. However, a compressive force must be maintained in order to keep the device in a closed state. Lose of compression will automatically result in the tool moving to an open state, regardless of whether the surface pump(s) are in operation or not. This is undesirable during a drilling operation. Furthermore, this particular device is constructed such that the major moving components operate in the slurry, leading to reliability problems. Also, similar to U.S. Pat. No. 6,161,632, breather ports located on the apparatus allow cuttings to enter the device, causing additional problems in relation to the reliability of the device.

This prior art device also relies on hydraulic pressure to achieve the required tensile loading. Owing to the configuration of the device, hydraulic lock can occur resulting in a build up of pressure. When the pressure builds beyond a predetermined value, a safety relieve disc bursts causing the device to default to an open state. The drill stem assembly must then be brought back to the surface so that the flushing device can be repaired or replaced.

The preceding discussion of the background to the invention is intended only to facilitate an understanding of the present invention. It should be appreciated that the discussion is not an acknowledgement or admission that any of the material referred to was part of the common general knowledge in Australia as at the priority date of the application.

It is an object of this invention to provide to ameliorate, mitigate or overcome, at least one disadvantage of the prior art, or which will at least provide the public with a practical choice.

DISCLOSURE OF THE INVENTION

The present invention provides a flushing device comprising:

an inner sleeve, axially slidable relative to an outer sleeve, the inner and outer sleeves cooperate to define an internal passage for the flow of a fluid, and are permanently coupled such that there is substantially no rotational movement between the two sleeves;

the outer sleeve having a plurality of flushing outlets an indexing mechanism which indexes between a first position, wherein the plurality of outlets are blocked from the internal passage such that the flushing device is in a closed condition, to a second position, wherein the plurality of outlets register with the internal passage such that the flushing device is in an open condition;

whereby fluid flows through the flushing device, the flushing device is configured such that it remains in the selected open or closed condition regardless of the forces acting thereupon.

Preferably in use the inner sleeve and outer sleeve are in mutual support and are connected directly to their respective sections in the drill assembly.

Preferably when there is substantially no fluid passing through the flushing member the inner sleeve and outer sleeve are axially movable through a limited predetermined length with respect to each other by remote regulation to open and close the flushing outlets.

Preferably the outlet provides a flushing outlet, whereby when the flushing device is in an open condition a predetermined percentage of the fluid is diverted from the passage.

Preferably the indexing mechanism comprises an indexing sleeve and a travel stop mounted on the inner sleeve for rotation about the longitudinal axis thereof. Preferably the travel stop is constrained against movement along the longitudinal axis of the inner sleeve. That is to say, axial movement of the travel stop is caused by forces exerted upon the inner sleeve.

Preferably the travel stop is adapted to co-operate with the indexing sleeve during the indexing sequence.

The indexing sleeve may have a first end which provides a bottom face and a second end having a projection, defining a pawl, extending in an axial direction from the periphery of said second end.

The travel stop may have a first end adapted to engage and mesh with the projection on the indexing sleeve, and a second end adapted to engage and mesh a portion of the outer sleeve. Preferably the portion of the outer sleeve is shaped to engage and mesh with the second end of the travel stop.

Preferably the second end of the travel stop is configured to provide a plurality of fingers and corresponding slots, which co-act with corresponding fingers and slots integral with the portion of the outer sleeve. Each finger and slot of the travel stop may terminate in a depression or trough. Each finger and slot of the portion of the outer sleeve may terminate in a peak. Each peak may be complimentary in shape to each trough so that upon engagement each finger and slot on the travel stop mates with each finger and slot on the portion of the outer sleeve.

Preferably during the indexing sequence, the fingers and slots on the travel stop are indexed from the first position, where the fingers mate in an opposed relation with the fingers on the portion of the outer sleeve, to the second position, where the fingers mate with the slots on the portion of the outer sleeve such that the fingers are interlaced with the fingers on the portion of the outer sleeve.

Preferably, when the fingers are in opposed relation the flushing outlet is closed and the flushing device is in its closed condition.

Preferably, when the fingers are in interlaced relation the flushing outlet is open and the flushing device is in its open condition.

The flushing device may comprise a locking mechanism which is capable of preventing substantial movement of the inner sleeve relative to the outer sleeve, which prevents the flushing device from unintentionally changing between open and closed conditions. The locking mechanism may comprise a plurality of holes in the inner sleeve, and a locking member having a plunger adapted to be received in the holes. The locking member may be constrained so as to only move in a radial direction. A biasing means may act upon the locking member, biasing it inwardly.

The locking member may be adapted to be received in a first or second groove on the inner face of the outer sleeve.

When the flushing member is in use, the pressure acting upon the plunger by the fluid flowing through the passage of the flushing device is greater than the biasing force exerted thereupon. This results in the locking member being forced outward and engaging with the first or second groove, depending upon the condition of the flushing device. Any downward movement exerted upon the inner sleeve relative to the outer sleeve will result in the locking member abutting a lower face of the groove to prevent further downward movement of the inner sleeve, preventing the flushing device from unintentionally changing between the closed and opened conditions.

The flushing outlet preferably comprises a plurality of apertures in the inner sleeve, an annular chamber in the outer sleeve and a plurality of nozzles, forming a passage between the annular chamber and the outside of the flushing device. Each nozzle may be shaped so as to direct diverted fluid backwards, away from the drill head.

Preferably the inner sleeve and outer sleeve define a cavity therebetween. The cavity may be filled with a lubricating fluid such as oil, providing an oil chamber. Preferably the indexing mechanism operates in the oil chamber. Preferably the oil chamber is sealed from the passage such that no slurry can contaminate the oil. This ensures that the slurry does not interfere with the operation of the flushing device, increasing its reliability.

The flushing device may also comprise means to balance and cushion the movement between the inner and outer sleeve. The means to balance and cushion may be in the form of a floating piston. The floating piston may equalise the pressure within the oil chamber.

The flushing device may comprise an intermediate sleeve located between the inner and outer sleeve and located between the flushing outlet and the outlet of the flushing device. The intermediate sleeve may ensure a fluid tight seal is provided between the inner and outer sleeve as the flushing device moves from a closed condition to an open condition.

A flushing device comprising an inner sleeve and an outer sleeve, moveable relative to each other between an open condition, wherein a percentage of the fluid passing through a central passage of the flushing device can be diverted through a plurality of flushing outlets, and a closed condition, wherein the fluid outlets are blocked from the passage, a locking mechanism operable between the inner and outer sleeves, and having engaging and releasing conditions, the locking mechanism being biased towards the release condition and being responsive to fluid pressure in the passage for movement against the influence of the bias into the engaging condition, whereby the locking mechanism, when in the engaging condition couples the inner sleeve to the outer sleeve to prevent substantial downward movement of the inner sleeve relative to the outer sleeve and preventing the flushing device from unintentionally changing its condition between open and closed.

Preferably the locking mechanism is activated when fluid is passes through the passage and de-activated when the fluid ceases to flow therethrough.

A method of flushing the annular space between a drill stem and the wall of a bore using a flushing device incorporated in the drill stem comprising the steps of:

stopping the flow of a slurry through the flushing device, such that a locking mechanism is caused to be released, allowing axial movement of an inner sleeve relative to an outer sleeve of the flushing device;

applying a force upon the inner sleeve in a first axial direction to force a travel stop, constrained upon the inner sleeve and in engagement with a portion of the outer sleeve, to disengage from said portion and move towards an indexing sleeve, with continued application of the force causing a ratchet on the travel stop to engage a pawl on the indexing sleeve, forcing the travel stop to rotate until an indent on the travel stop mates with the pawl;

applying a further force to the inner sleeve in a second axial direction to cause the travel stop to disengage from the indexing sleeve and move toward the portion of the outer sleeve until the travel stop aligns and meshes with the portion of the outer sleeve in such a relationship that a plurality of flushing outlets register with the passage;

allowing the fluid to pass through the flushing device causing the locking mechanism to lock the inner sleeve to the outer sleeve, such that substantial downward movement of the inner sleeve relative to the outer sleeve in said first direction is prevented, wherein a percentage of the fluid is diverted from the passage to pass to the annular space through the flushing outlet to assist in cleaning the bore.

The invention also provides a flushing device for flushing diverted fluid upwards into an annular space between a drill stem and a hole, where a slurry passes through a central passage of the flushing device to a drill head, whereupon it reverses direction, passing through the annular space before returning to the surface with cuttings from the drilling process suspended in the return slurry, the flushing device is adapted to change between an open condition, whereby a predetermined percentage of fluid is diverted from the passage to the annular space to assist in maintaining a clean bore, and a closed condition, whereby the full flow of the slurry is delivered to the drill head, and is configured such that the application or reduction of force acting thereupon whilst the slurry is passing therethrough, does not alter the condition of the flushing device.

The present invention also provides a flushing device comprising:

an inner sleeve, slidingly received in an outer sleeve, the inner and outer sleeves cooperating to define an internal passage for the flow of a fluid, and being permanently coupled such that there is no rotational movement between the two sleeves;

the outer sleeve having a plurality of flushing outlets an indexing mechanism which indexes between first and second positions such that the flushing device moves between an open condition, whereby the plurality of flushing outlets are open for discharging a quantity of the fluid from the internal passage, and a closed condition whereby the plurality of flushing outlets are closed;

the flushing device being constrained against movement out of the selected open or closed condition whilst the fluid is passing therethrough.

BRIEF DESCRIPTION OF THE DRAWINGS

The invention will be better understood by reference to the following description of a specific embodiment thereof as shown in the accompanying drawings in which.

BEST MODE(S) FOR CARRYING OUT THE INVENTION

Figure 1:
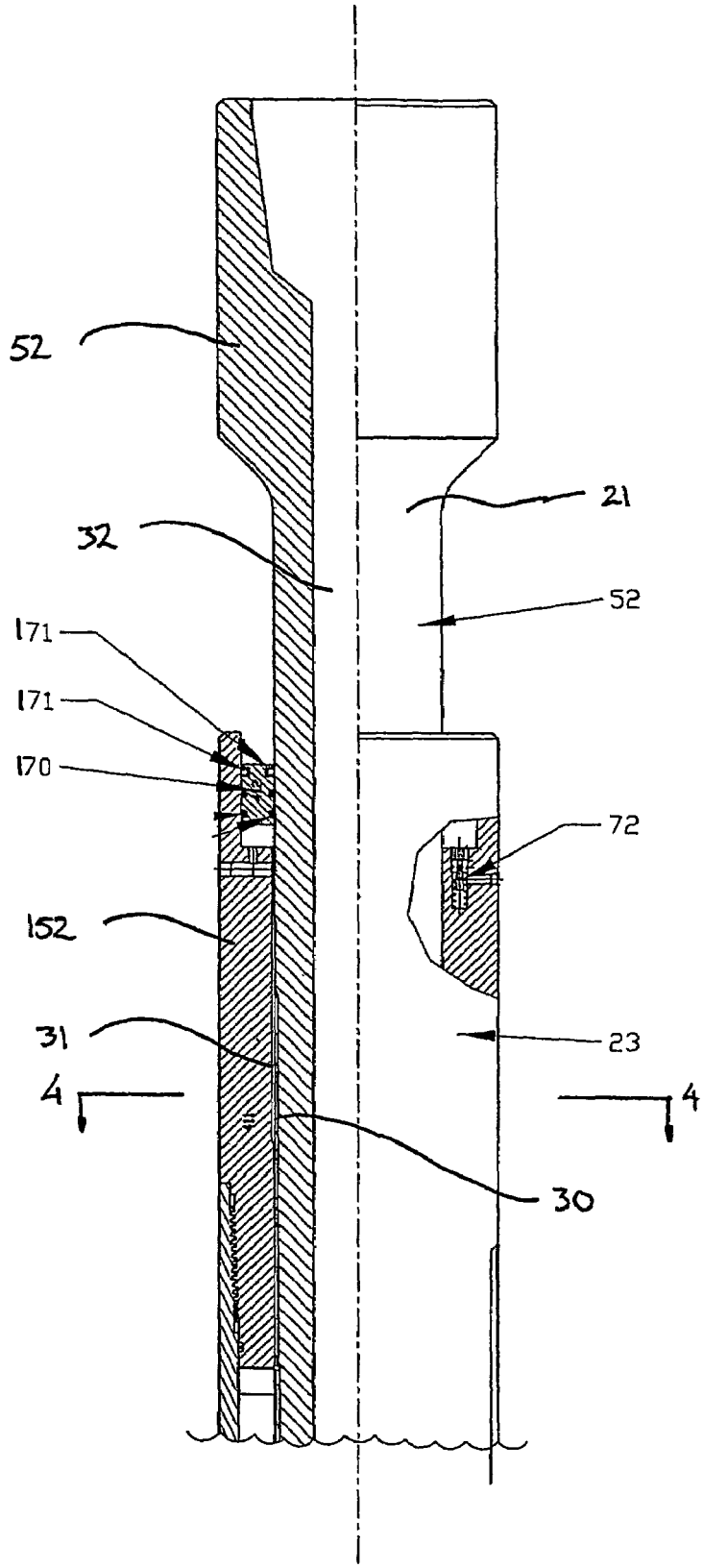
FIG. 1 is a part sectional view of an upper portion of a flushing device according to a first embodiment of the invention.
Figure 2:
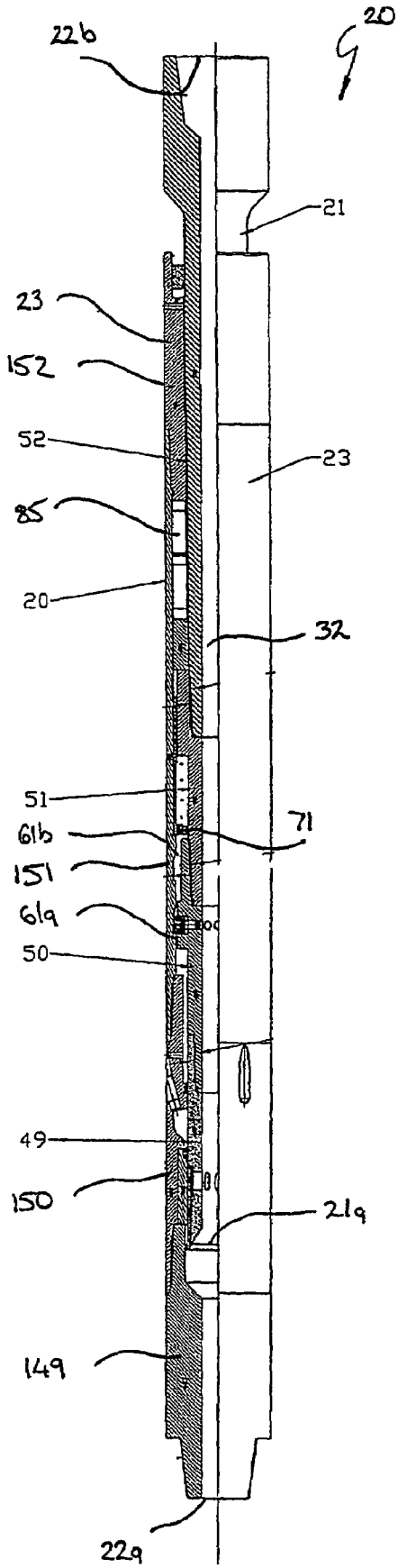
FIG. 2 is a part sectional view of the flushing device in a closed condition.
Figure 3:
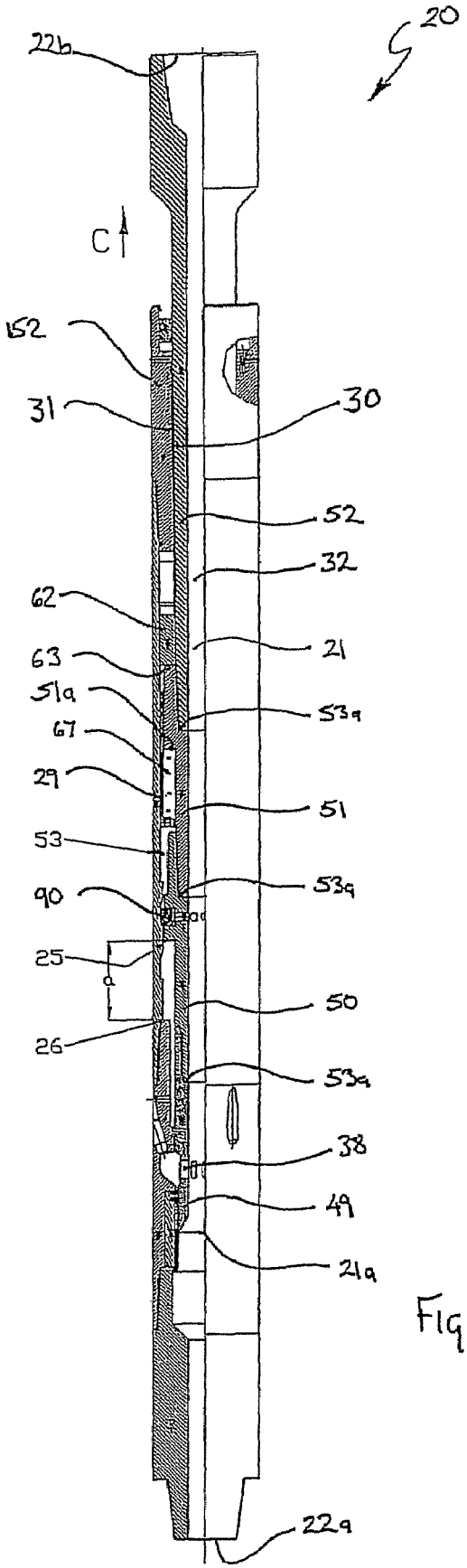
FIG. 3 is a part sectional view of the flushing device in an open condition.

Referring to FIGS. 1 to 3, the invention according to an embodiment is a flushing device 20, comprising an outlet 22*a*, an inlet 22*b*, an inner sleeve 21 and an outer sleeve 23, which cooperate to provide a fluid passage 32.

Inner Sleeve

The inner sleeve 21 comprises a first inner portion 49 located at a first end 21*a* of the inner sleeve 21. The first inner portion 49 is secured through threading engagement to a second inner portion 50 which is secured through threading engagement to a third inner portion 51 which in turn is secured through threading engagement to a fourth inner portion 52. The fourth inner portion 52 defines the inlet 22*b* of the flushing device 20, and is adapted to be releasable incorporated in the drill stem assembly.

A plurality of seals 53*a* are positioned at the interface between each portion 49, 50, 51, 52 so as to prevent the leakage of fluid from the passage 32, through the threaded interface between each portion and into an oil chamber 53 (which will be described in further detail below).

Figure 7:
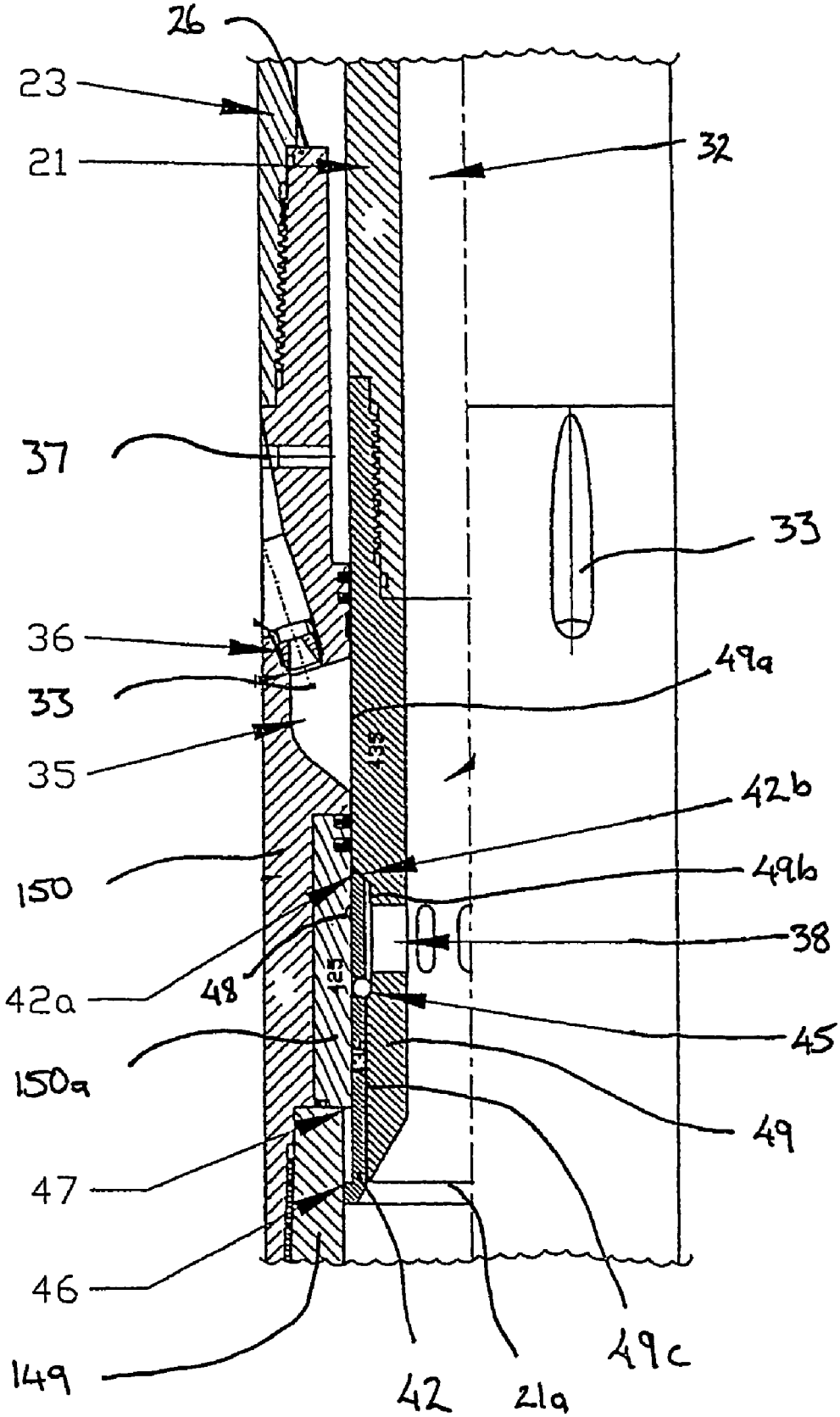
FIG. 7 is a part sectional view of the flushing outlets of the flushing device when in a closed condition.
Figure 8:
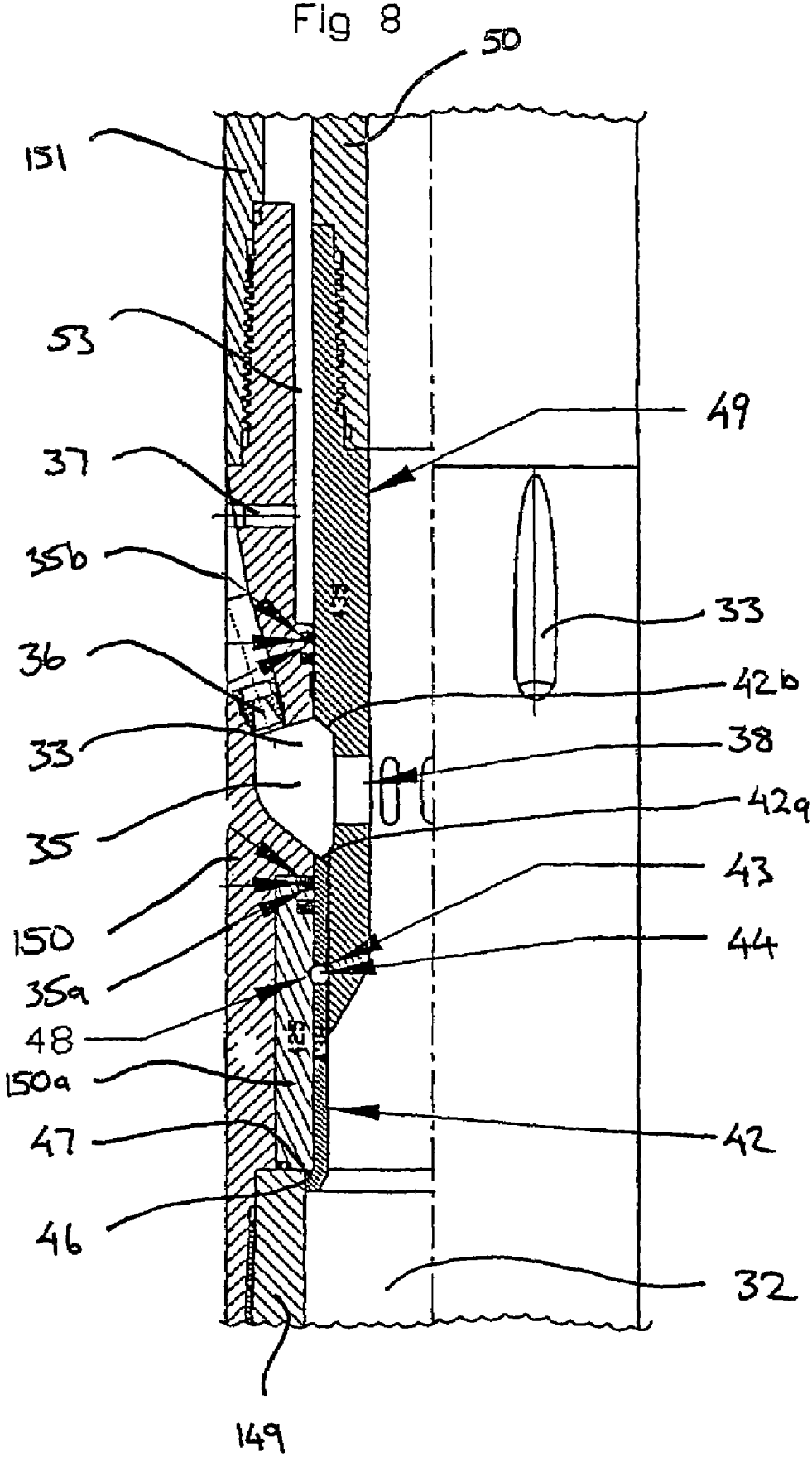
FIG. 8 is a view similar to FIG. 7 but with the flushing outlets in an open condition.

Referring to FIGS. 7 and 8, the first inner portion 49 provides a plurality of apertures 38 spaced annually therearound, providing a passage from the inner surface to the outer surface. The outer surface of the first inner portion 49 has a first region 49*a* of large diameter, a second region 49*b* of reduced diameter, and a third region 49*c* of a diameter smaller than the first region 49*a* but larger than the second region 49*b*.

The transition between the first region 49*a* and second region 49*b* is provided by a sloping face 42*b*. Similarly the transition between the second region 49*b* and third region 49*c* is provided by a sloping face 45.

Figure 9:
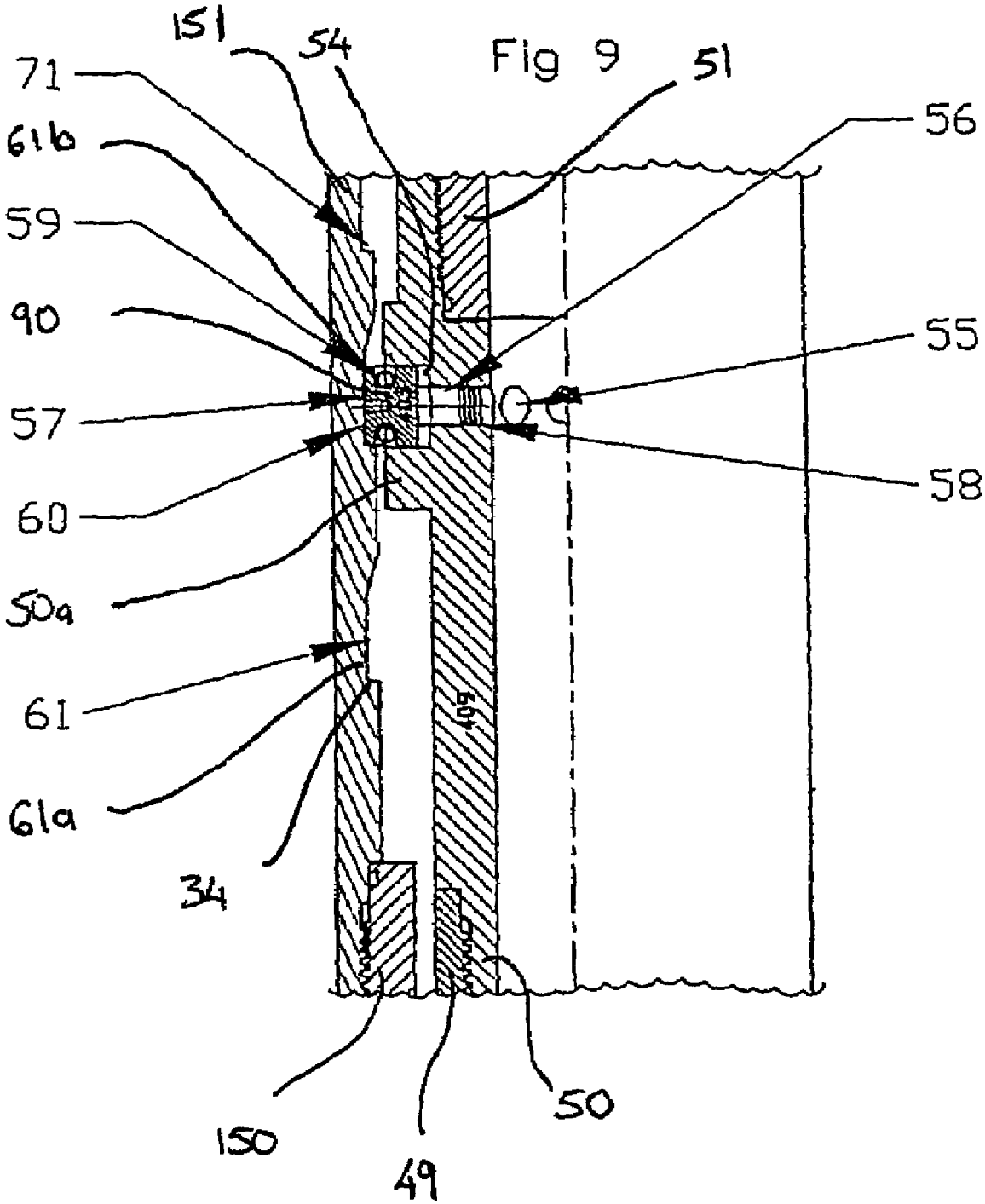
FIG. 9 is a part sectional view of a locking mechanism of the flushing device.

Referring to FIG. 9, the second inner portion 50 has an outer surface which comprises a thickened portion 50*a*. The thickened portion 50*a* is designed to incorporate an annular groove 54 for receipt of a locking mechanism 90. The second inner portion 50 also comprises a plurality of holes 55 spaced annually therearound. The holes 55 are in communication with the groove 54 to receive the locking mechanism 90, which will be further described below.

Figure 10:
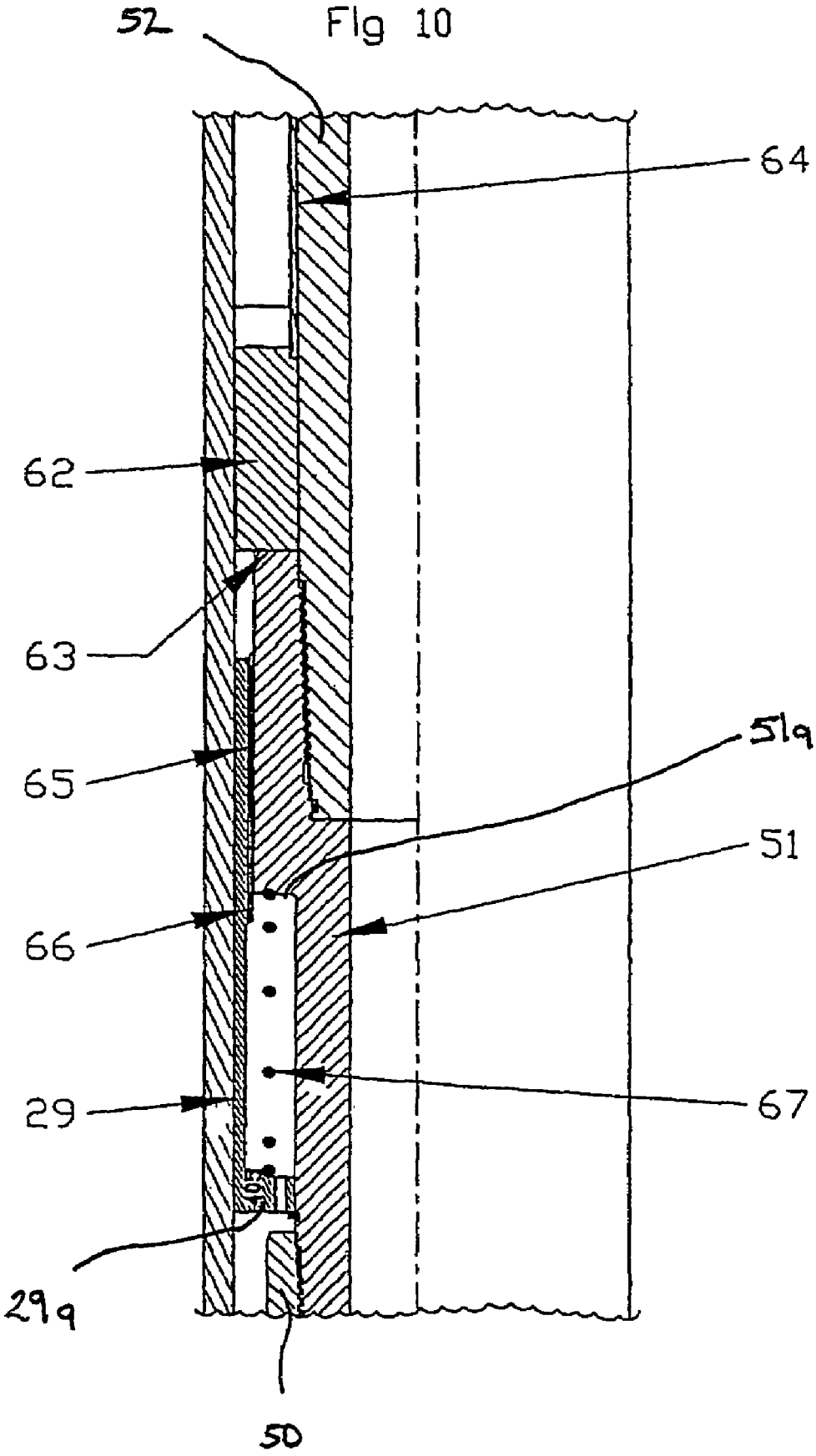
FIG. 10 is a part sectional view of the indexing mechanism.

Referring to FIG. 10, the third inner portion 51 provides a first shoulder 51*a* on its outer surface for containment of a spring 67, as will be discussed further below. A region of the outer surface of the third inner portion 51 provides a plurality of spline teeth 65 which cooperate with mating spline teeth 66 located on the inner surface of an indexing sleeve 29 to prevent the rotation of the indexing sleeve 29 relative to the inner sleeve 21, which will be further discussed below. The third inner portion 51 also provides a second shoulder 63 which abuts against a rotating travel stop 62.

Figure 4:
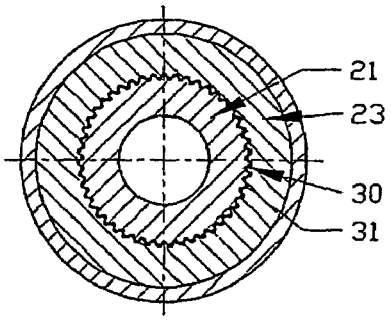
FIG. 4 is a cross sectional view of the flushing device through 4-4 of FIG. 1.

Referring to FIGS. 1 and 4, a region of the outer surface of the fourth inner portion 52 provides a plurality of spline teeth 30 which mate with corresponding spline teeth 31 on the inner face of a fourth outer portion 152 of the outer sleeve 23. The interaction of the spline teeth 30 and 31 prevent the inner sleeve 21 rotating relative to the outer sleeve 23.

Outer Sleeve

The outer sleeve 23 of the flushing device 20, defines the outlet 22*a* of the flushing device 20 at its first end. Extending from the outlet 22*a* the outer sleeve 23 comprises first outer portion 149, which is secured through threading engagement to a second outer portion 150, which is secured through threading engagement to a third outer portion 151, and which in turn is secured through threading engagement to a fourth outer portion 152.

The first outer portion 149 is adapted to be releasably incorporated in the drill stem assembly.

Referring to FIGS. 7 and 8, the second outer portion 150 provides a plurality of flushing outlets 33. These outlets 33 allow fluid to pass from passage 32 to the annular space between the flushing device 20 and a bore wall of the bore being drilled, when the flushing device 20 is in an open condition, as represented in FIG. 8.

The second outer portion 150 comprises an annular sleeve 150*a* which defines the shoulder 47 adjacent the first outer portion 149. The shoulder 47 projects radially inward to stand proud of the inner surface of first outer portion 149 as shown in FIG. 7. The annular sleeve 150*a* also provides an annular groove 48 on its inner face, spaced at a predetermined distance from the shoulder 47.

The flushing outlet 33 comprises an annular chamber 35 located on the inner face of second outer portion 150, and a plurality of nozzle assemblies 36 in communication with the annular chamber 35 and spaced around the perimeter of the flushing device 20. Each flushing outlet 33 extends obliquely outwards and backwards.

The second outer portion 150 also provides a port 37 which is in communication with the oil chamber 53 allowing it to be filled with oil if so required.

Figure 12:
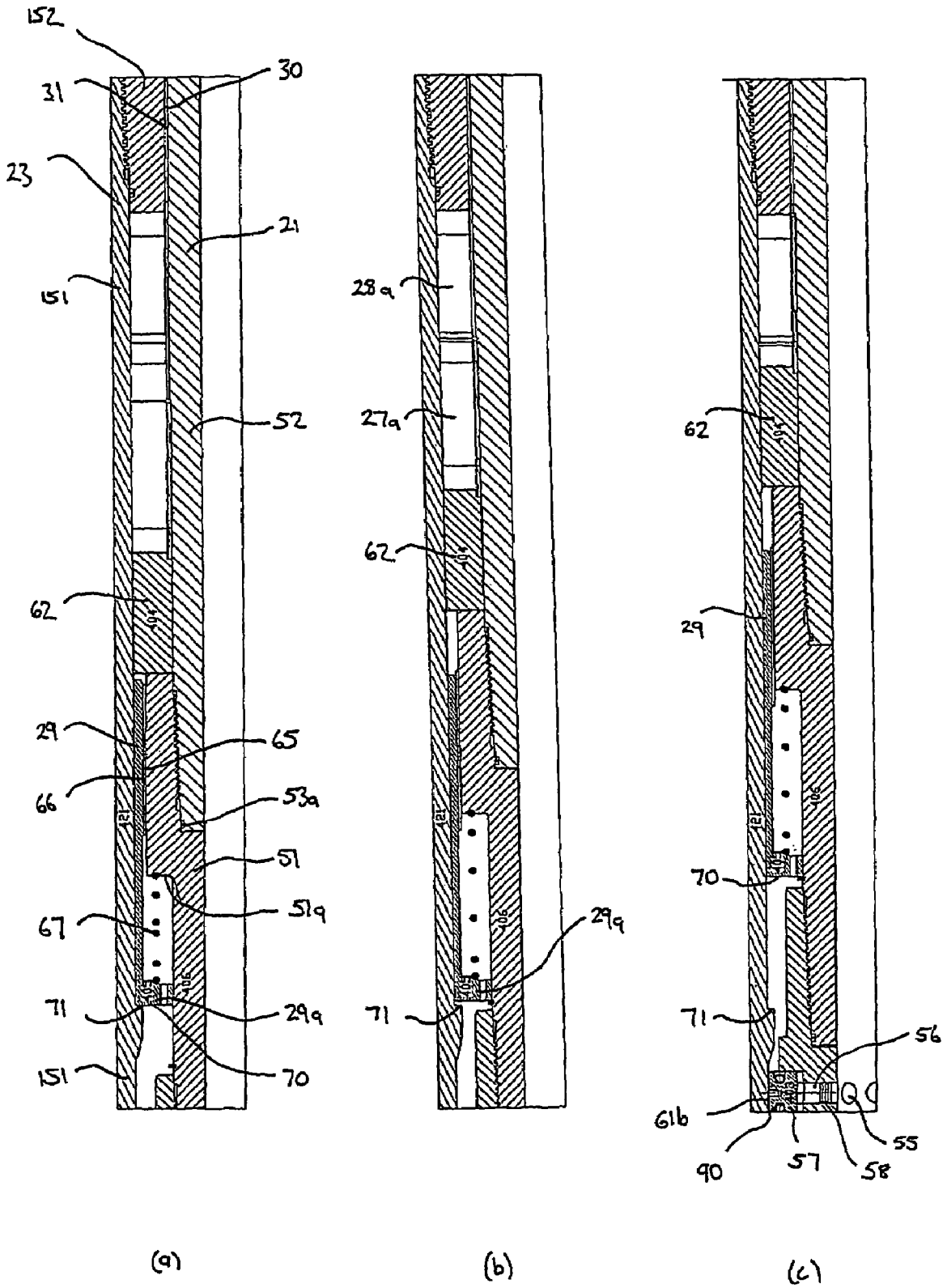
FIG. 12*a* to *c* is a part sectional view of the indexing mechanism as the flushing device moves from an open to a closed condition.

The inner face of the third outer portion 151 provides two annular grooves 61*a* and 61*b* as best shown in FIG. 9. Each annular groove 61*a* and 61*b* has a shoulder 34, and is configured so as to receive locking mechanism 90 as will be further described below. Located adjacent groove 61*b* the third outer portion 151 also provides a shoulder 71, as shown in FIGS. 2, 9 and 12. This shoulder 71 is designed to abut against bottom face 70 of the indexing sleeve 29 during various operational sequences of the flushing device 20.

Figure 5:
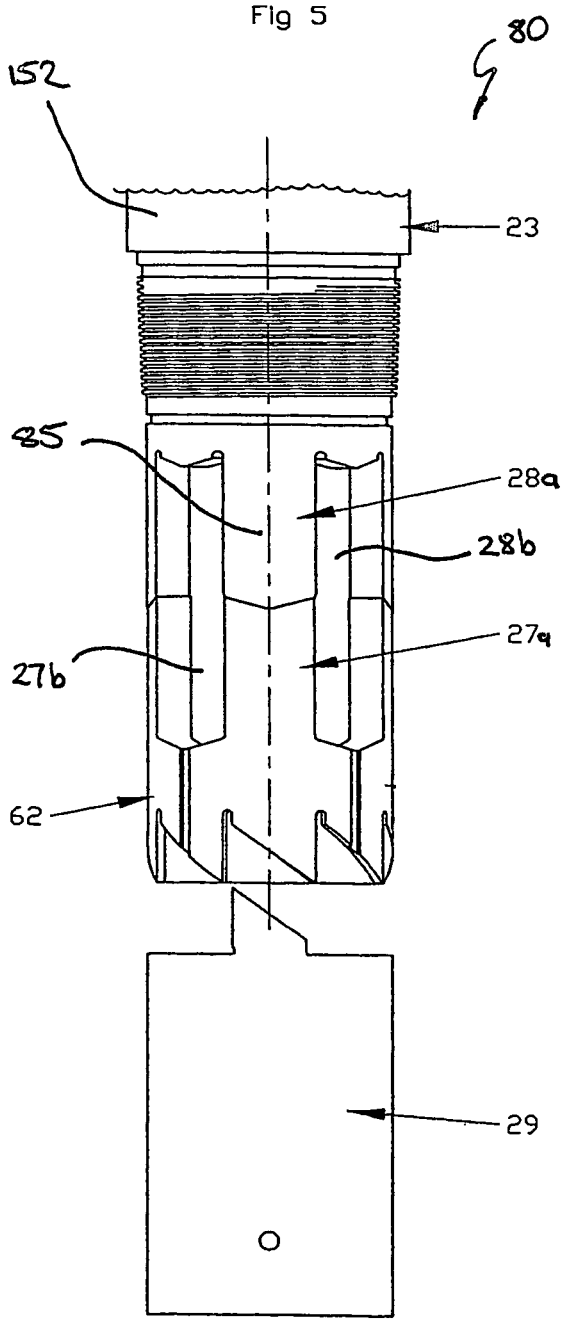
FIG. 5 is a view of an indexing mechanism of the flushing device in an opposed relation.
Figure 6:
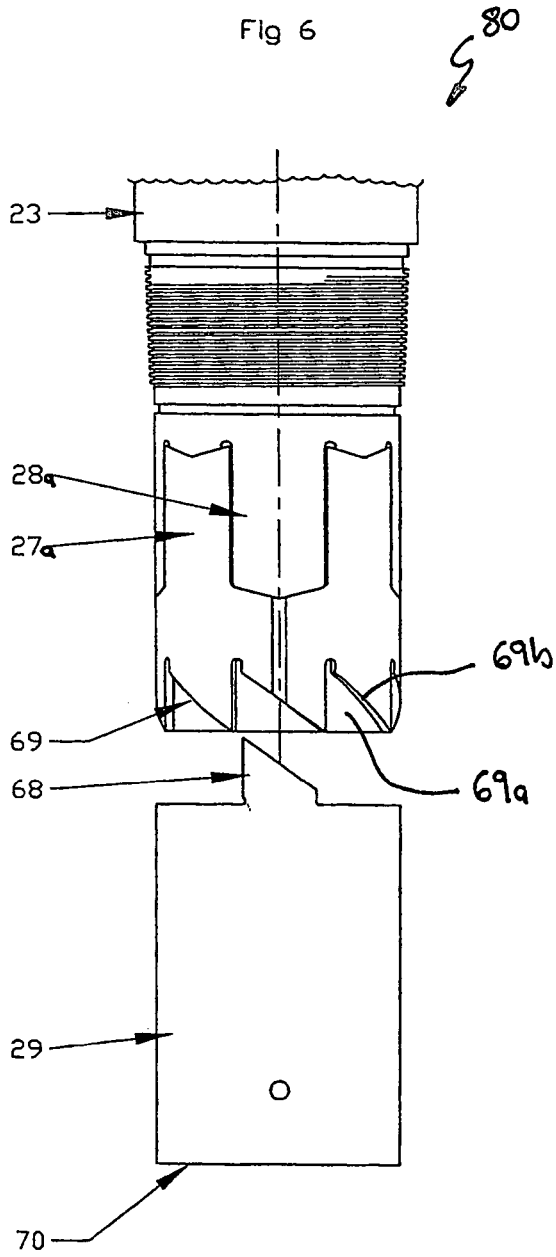
FIG. 6 is a view similar to FIG. 5 but with the indexing mechanism in an interlaced relation.

The fourth outer portion 152 provides a plurality of fingers 28*a* at its first end 85, as best shown in FIGS. 5, 6 and 12. These fingers 28*a* provide components of an indexing mechanism 80 which will be described in greater detail below.

Referring to FIG. 1, the fourth outer portion 152 of the outer sleeve 23 cooperates with the fourth inner portion 52 of the inner sleeve 21 to contain a floating piston 170, providing a seal between the inner sleeve 21 and the outer sleeve 23. The function of the floating piston 170 will be further described below.

Intermediate Sleeve

Referring to FIGS. 7 and 8, the flushing device 20 also comprises an intermediate sleeve 42 located between the first inner portion 49 of the inner sleeve 21, and the first outer portion 149 and second outer portion 150 of the outer sleeve 23.

The intermediate sleeve 42 comprises a outwardly extending shoulder 46 at its first end, and terminates at its other end with a sloping face 42*a*. The sloping face 42*a* is adapted to mate with upwardly sloping face 42*b* located on the first inner portion 49 of the inner sleeve 21 to provide a seat when the flushing device 20 is in a closed condition.

The intermediate sleeve 42 also contains a plurality of holes 43, each which receives ball 44. Each ball 44 has a diameter greater than the radial thickness of the intermediate sleeve 42 such that when the intermediate sleeve 42 is at its lower most position, as shown in FIG. 7, each ball 44 protrudes beyond the inner face of the intermediate sleeve 42 and rests against the downwardly sloping face 45 of the first inner portion 49. The mating of seat portion 42*a* of the intermediate sleeve 42 with the upwardly sloping face 42*b* of the inner sleeve 21 is at a predetermined distance from the plurality of holes 43 such that the balls 44 are not permitted to enter aperture 38.

Operation of Flushing Outlet

In operation, movement of the inner sleeve 21 in an upward direction causes the downwardly sloping face 45 to abut against each ball 44, as shown in FIG. 7, causing the intermediate sleeve 42 to move upwardly with the inner sleeve 21. Continued upward movement will result in the outwardly extending shoulder 46 of the intermediate sleeve 42 abutting against shoulder 47 provided by the annular sleeve 150*a*. This abutment occurs as each ball 44 aligns with annular groove 48 allowing each ball 44 to be received therein, as shown in FIG. 8.

This enables the first inner portion 49 of the inner sleeve 21 to continue to move upwardly whilst intermediate sleeve 42 remains locked in position. Continued upward movement of inner sleeve 21 will result in the plurality of apertures 38 aligning with and open to the flushing outlet 33, as shown in FIG. 8.

The operation of the intermediate sleeve 42 ensures the apertures 38 remain closed until the aperture begins to align with annular chamber 35 of the flushing outlet 33. When a gap is introduced between the sloping face 42*b* and conical face 42*a*, the pathway for the fluid to pass from the passage 32, through the slots 38 and through the flushing outlet 33 opens.

The annular chamber 35 has a set of seals 35*a*, 35*b* adjacent each side thereof. These seals render the interface between the inner sleeve 21 and outer sleeve 23 fluid tight, preventing slurry passing from the passage 32, into the interface, and into the oil chamber 53 when the flushing device 20 is in an open condition. When the flushing device is in a closed condition the first region 49*a* of the first inner portion 49 co-acts with seals 35*a* to provide a seal. As the inner sleeve 21 moves upwardly relative to outer sleeve 23, the intermediate sleeve 42 moves upwardly to replace the inner portion 49*a* and co-act with the seals 35*a* to provide a seal below the annular chamber 35 preventing fluid passing through the apertures 38 and ingressing between the inner sleeve 21 and outer sleeve 23.

When the flushing device 20 moves to a closed position as shown in FIG. 2, the inner sleeve 21 moves downwardly relative to outer sleeve 23, providing a barrier between the inner passage 32 and the annular chamber 35 of the flushing outlet 33. Continued movement of the inner sleeve 21 will result in the sloping face 42*b* abutting mating conical face 42*a* of the intermediate sleeve 42 whilst simultaneously the downwardly facing slope 45 passes groove 48. Each ball 44 will then be forced to move in an inward direction resulting in the intermediate sleeve engaging the inner sleeve 21 and move downwardly with further downward movement of the inner sleeve 21.

Sloping face 42*b* and conical face 42*a* remain in intimate contact until they have passed seals 35*a*.

Indexing Mechanism

Figure 11:
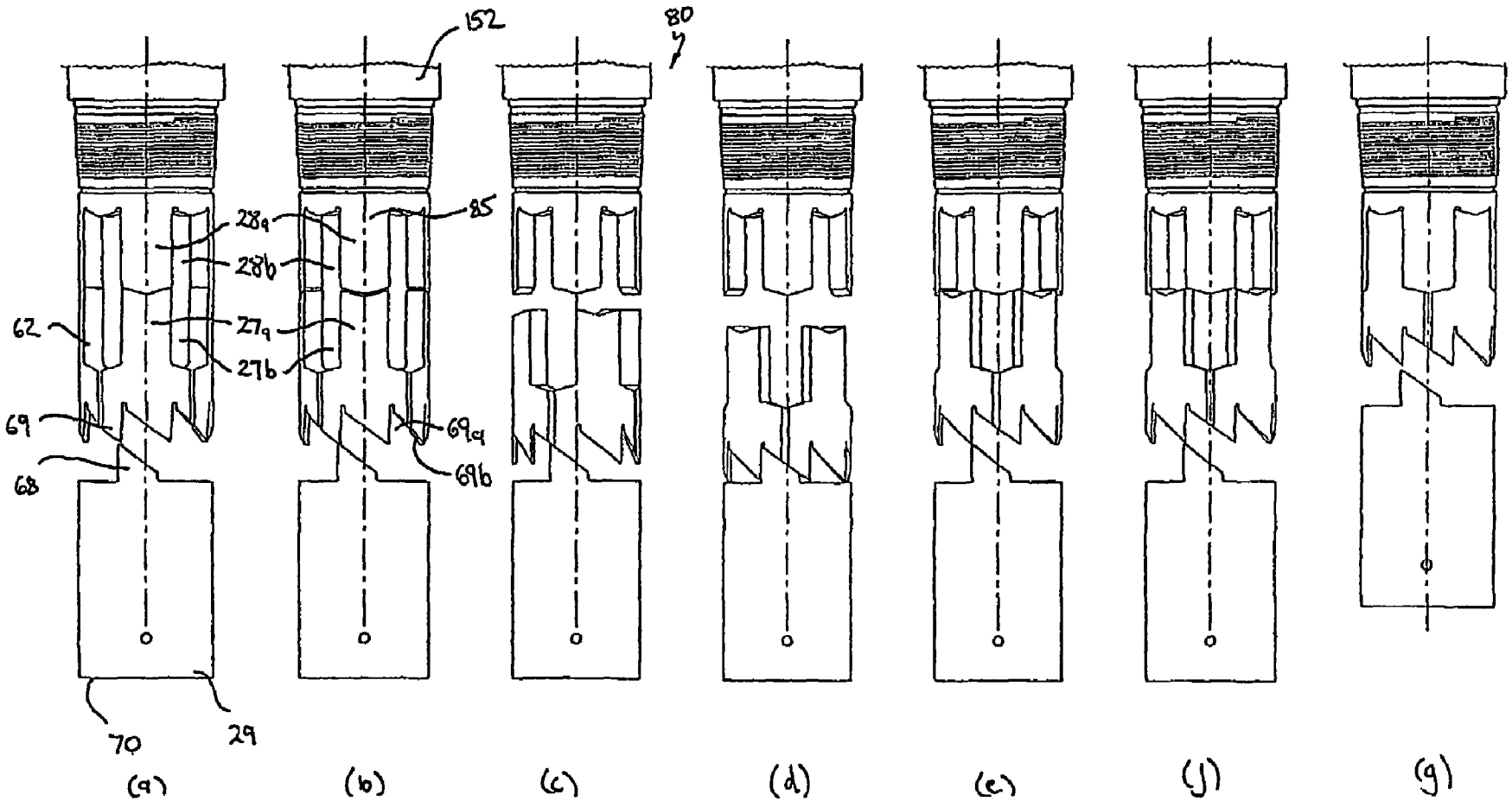
FIG. 11*a* to *g* is a view of the indexing mechanism according to the sequence of positions as it moves between an opposed (FIG. 11*a*) to interlaced (FIG. 11*g*) relation.

The flushing device 20 is also provided with a indexing mechanism 80 as best shown in FIGS. 5, 6 and 11. The indexing mechanism 80 comprises indexing sleeve 29, rotating travel stop 62, and a plurality of fingers 28*a* and slots 28*b* integral with the first end 85 of the fourth outer portion 152 of the outer sleeve 23.

The indexing sleeve 29 provides a pawl 68 projecting from an end thereof. Referring to FIG. 10, the indexing sleeve 29 also provide the series of spline teeth 66 on its inner surface which mate with corresponding spline teeth 65 on the outer surface of the third inner portion 51 of the inner sleeve 21 to prevent rotational movement of the indexing sleeve 29, as previously discussed. The indexing sleeve 29 also comprises a projection 29*a* extending inwardly from a first end of the indexing sleeve 29, as best shown in FIGS. 10 and 12. The projection 29*a* provides a face upon which spring 67 acts to bias the indexing sleeve 29 towards the shoulder 71 of third outer portion 152.

The rotating travel stop 62 provides a ratchet 69 comprising a plurality of indents 69*a* which are adapted to receive pawl 68. In particular, each indent 69*a* comprise a ramp 69*b* which slidingly engages pawl 68. Travel stop 62 also provides a plurality of fingers 27*a* and slots 27*b*, each being configured to provide a trough 81 at their periphery. These troughs mate with corresponding peaks 82, located at the periphery of each finger 28*a* and slot 28*b* of the first end 85 of the fourth outer portion 152, in various sequences during the operation of the flushing device 20.

Operation of the Indexing Mechanism

The operation of the indexing mechanism 80 is best described with reference to FIGS. 11 and 12. When the flushing device 20 is in a closed condition, downward movement of the inner sleeve 21 with respect to the outer sleeve 23 will result in a portion of the bottom face 70 of the indexing sleeve 29 abutting shoulder 71 of the third outer portion 151 of the outer sleeve 23, preventing further downward movement of the indexing sleeve 29 relative to the outer sleeve 23.

Continued downward movement of the inner sleeve 21 will result in travel stop 62 moving towards indexing sleeve 29 causing the fingers 27*a* to disengage from the fingers 28*a*, as shown in FIG. 11*b*.

Continued downward movement will result in the ratchet 69 engaging the pawl 68 which is offset sufficiently from the plurality of indents 69*a* so that the front region of the ramp 69*b* of an indent 69*a* engages a top portion of the pawl 68 as also best shown in FIG. 11*b*.

Continued downward movement will result in travel stop 62 rotating as the ramp 69*b* slides down the face of the pawl 68. This will continue until the indent 69*a* completely receives the pawl 68, as shown in FIG. 11*d*.

Referring to FIGS. 11*e-f*, when the inner sleeve 21 is caused to move upwardly, the travel stop 62 also moves upwardly, disengaging from the indexing sleeve 29 and moving towards the first end 85 of the fourth outer portion 152. As indicated in FIG. 11*e*, the fingers 27*a* do not entirely align with slots 28*a*. However, due to the configuration of the peaks 82 and trough 81, continued upward movement of the inner sleeve 21 results in the fingers 27*a* sliding over the fingers 28*a* to cause further rotation of the travel stop 62 until the fingers 27*a* align with slots 28*a* at the end 85, such that the fingers and slots are interlaced. Continued upward movement of the inner sleeve 21 will result in the engagement of the fingers 27*a* with the slots 28*b*. When the fingers 27*a* and 28*a* are interlaced the flushing outlets 33 are open, and the flushing device 20 is in an open condition.

A similar process will in turn cause the rotating travel stop 52 to be indexed to a second position whereby the fingers 27*a* align with fingers 28*a* such that they are in an opposed relation. When the fingers 27*a* and 28*a* are opposed the flushing outlets 33 are closed, and the inner sleeve 21 can only be drawn up far enough for the pawl 68 to disengage the ratchet 69.

Referring to FIG. 10, the axial movement of the rotating travel stop 62 is restricted to the movements of the inner sleeve 21. Downward movement of the travel stop 62 relative to inner sleeve 21 is prevented by second shoulder 63 of the third inner portion 51. Upward movement of the travel stop 62 relative to the inner sleeve 21 is prevented by bush 64. The rotational movement of the travel stop 62 is governed by the actions of the flushing device 20 and the travel stops 62 position with respect to indexing sleeve 29, and fingers 28*a* and slots 28*b*.

Locking Mechanism

Figure 13:
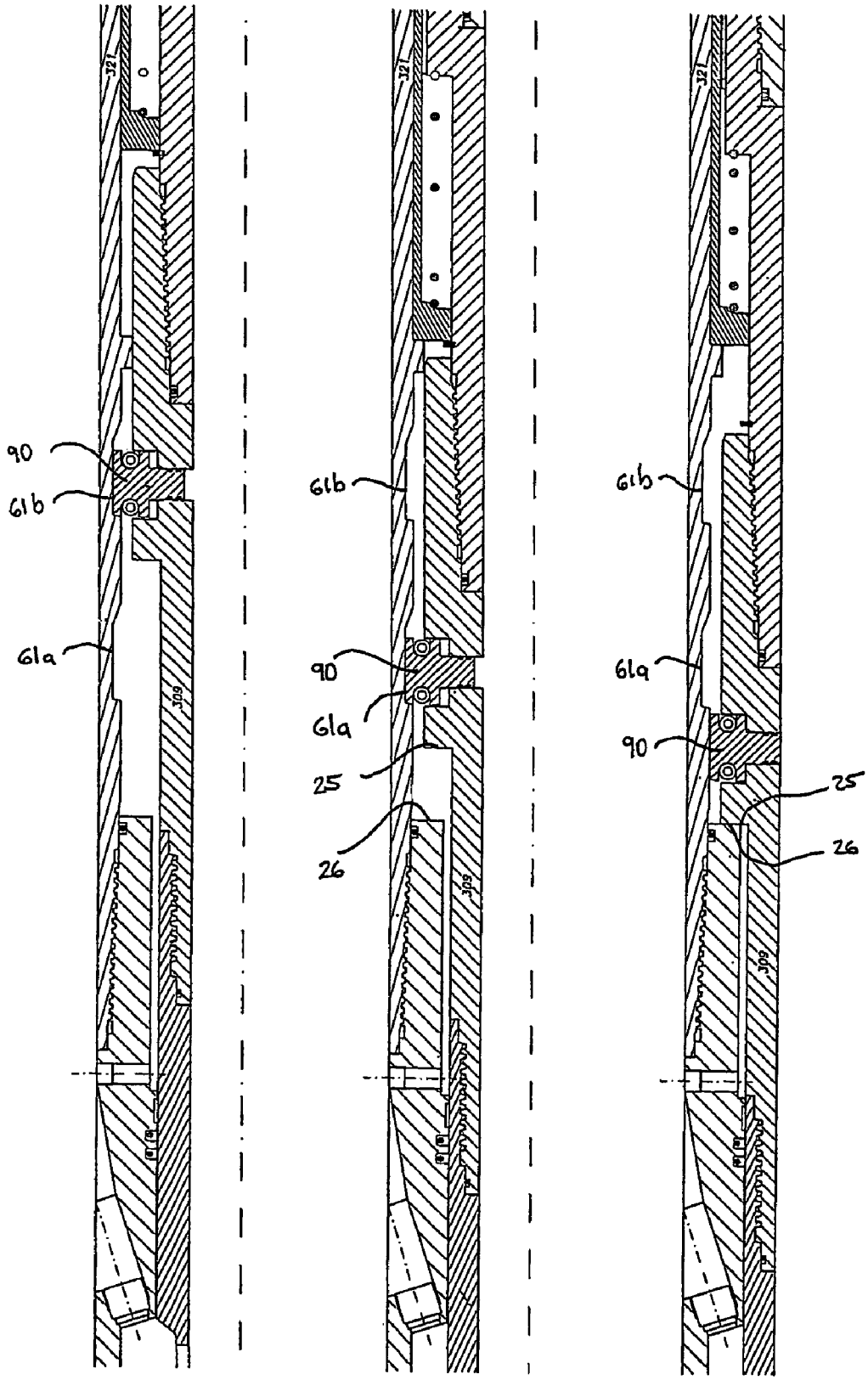
FIG. 13*a* to *c* is a part sectional view of the locking mechanism as the flushing device moves between an open and closed condition.

Referring to FIGS. 9 and 13, the locking mechanism 90 provides means in which downward movement of inner sleeve 21 relative to outer sleeve 23 is prevented when fluid is passing through the flushing device 20. The locking mechanism 90 comprises a plurality of locking heads 57 with a plunger 56 extending therefrom. Each locking head 57 is received and seated in groove 54 such that the plunger 56 can be received in hole 55 of second inner portion 50 of the inner sleeve 21. Each plunger has a set of seals 58, preventing leakage of drilling fluid from the passage 32.

The locking mechanism 90 is biased radially inwardly by biasing means in the form of a plurality of garter springs 59.

When fluid is passing through the inner passage 32 the pressure acts radially on the plunger 56. When this pressure is greater than the inward force provided by the springs 59, the locking mechanism 90 is forced to move radially outward. When this occurs each locking head 57 engages the third outer portion 151 of the outer sleeve 23 and sits in either groove 61*a* or 61*b*, depending upon the condition of the flushing device 20.

When the locking head 57 is in engagement with a groove, inner sleeve 21 is prevented from moving downwardly relative to outer sleeve 23 as each lock head 57 will be caused to abut shoulder 34 of the groove 61*a*, 61*b*.

In order to disengage each locking head 57 from the groove 61*a*, 61*b* the surface pumps will need to stop pumping the slurry through passage 32 allowing the pressure in the passage 32 to decrease. As this occurs the force acting on each plunger 56 will reduce resulting in the springs 59 biasing the locking mechanism 90 inwardly, and allowing the inner sleeve 21 to move downwardly relative to outer sleeve 23, such that the flushing device 20 can change between conditions.

Floating Piston

As shown in FIG. 1 and previously discussed, the fourth inner portion 52 of the inner sleeve 21 and the fourth outer portion 152 of the outer sleeve 23 cooperate to retain a floating piston 170. The floating piston 170 defines the upper limit of the oil chamber 53, whose lower limit is defined by the seals 35*b* fitted above the annular chamber 35. The floating piston 170 is used in order to equalize the pressure within the oil chamber 53 with the pressure in the annular space. This ensures correct operation of the locking mechanism 90 and removes the possibility of a large pressure differential across the outer sleeve 23.

The spring-loaded valve 72 of a conventional type is fitted to the oil chamber 53 to eliminate the possibility of residual pressure differentials which may occur.

The floating piston 170 is provided with seals to seal the interface between the piston 70, the outer sleeve 23 and the inner sleeve 21. In addition scrapers 171 are fitted to the floating piston 170 to assist in maintaining a clean surface for the seals.

Operation of the Flushing Device

The operation of the flushing device 20 between an open condition and a closed condition, and vice versa, is extremely simple and reliable, and allows the condition of the flushing device 20 to remain in that condition without the requirement of maintaining either a compressive or tractive force on the device 20.

Referring to FIGS. 2 and 3, the passage 32 through which fluid passes is defined largely by the inner wall of the inner sleeve 21. This inner wall substantially provides a barrier, preventing the ingress of slurry in to the cavities between the inner sleeve 21 and outer sleeve 23. Where apertures 38 and groove 54 are provided, seals are provided to prevent leakage of the slurry.

The cavity between the inner sleeve 21 and outer sleeve 23 provides the oil chamber 53 which assists in lubricating all moving parts within that area. This oil chamber can be filled through the filling port 37, as previously mentioned.

In the closed position the indexing mechanism 80 is arranged such that the fingers 27*a* are in opposed relation with fingers 28*a*, as shown in FIG. 11*a*. In this mode the flushing outlet 33 is closed.

In order for the flushing device 20 to move from the closed condition, shown in FIG. 2, to the open condition, shown in FIG. 3, the surface pumps are momentarily switched off so that the pressure in the passage 32 is sufficiently reduced to allow the springs 59 to move the locking mechanism 90 radially inward so that each plunger 56 moves inwardly to engage holes 55. The locking mechanism 90 is no longer in engagement with groove 61*a* and the inner sleeve 21 is free to move in an axial direction relative to outer sleeve 23.

As the pumps are stopped a compressive force is exerted on the inner sleeve 21. This results in the indexing sleeve 29 abutting shoulder 71 of third outer portion 151, as shown in FIG. 12*a*. Further downward movement of the inner sleeve 21 will result in compression of spring 67 as the first shoulder 51*a* on the third inner portion 51 moves towards the bottom surface 70 of the indexing sleeve 29.

As the inner sleeve 21 moves downwardly the rotation travel stop 62 is caused to move towards the indexing sleeve 29. As previously discussed the travel stop 62 disengages from the end portion 85 (FIG. 11*b*) and engages the pawl 68 on the indexing sleeve 29. Further movement of inner sleeve 21 causes the ramp 69*b* of the indent 69*a* to slidingly abut the pawl 68, causing the travel stop 62 to rotate until the indent 69*a* fits over pawl 68 (FIG. 11*d*). At this point the travel stop 62 has rotated so that the fingers 27*a* are nearly aligned with corresponding slots 28*b* of the end portion 85.

A tractive force is then applied to inner sleeve 21 causing the travel stop 62 to disengage from the indexing sleeve 29 (FIG. 11*e*) and move towards the end portion 85. As the travel stop 62 approaches end portion 85 the end of fingers 27 contact the end of fingers 28*a*. Owing to the peak configuration 82 of fingers 28*a* the travel stop 62 is caused to further rotate such that the fingers 27*a* now align with slots 28*b* (FIG. 11*f*).

Continued upward movement of the inner sleeve 21 will result in the end of fingers 27*a* abutting the bottom surface of the slots 28*a* such that the fingers 27*a* and 28*a* are in an interlaced configuration.

As the fingers 27*a* and 28*b* become interlaced the upward movement of the inner sleeve 21 has caused the first inner portion 49 of the inner sleeve 21 to disengage intermediate sleeve 42 and allow the apertures 38 to align with flushing outlets 33. This condition is depicted in FIGS. 3 and 8 whereby the inner sleeve 21 has moved a distance $\alpha$ relative to the outer sleeve 23.

At this point the pumps are switched on and fluid passes through passage 32, causing the pressure in passage 32 to increase. This results in the locking mechanism 90 to move outwardly such that the head 57 is received in groove 61*b*, as shown in FIG. 13*a*. The locking mechanism 90 therefore prevents the closure of the flushing outlet 33 whilst the pressure in passage 32 is greater than the pressure outside of the flushing device 20. The flushing device 20 is in an open condition.

When the flushing device 20 is in an open condition a percentage of fluid is diverted from passage 32 through flushing outlet 33, exiting from the flushing device 20 into the annular space between flushing device 20 and the wall of the bore. The percentage of fluid diverted is largely dependant of the size of the orifice of nozzle assembly 36, and may be adjusted accordingly. The diverted fluid is used to assists in cleaning the bore of cuttings.

Similarly, to close the flushing outlet 33 and cause the flushing device 20 to move to a closed condition, the pumps are switched off so that the pressure in the passage 32 is less than the pressure on the outside of the flushing device 20 causing the springs 59 of the locking mechanism 90 to urge the plunger 56 inwardly to engage with holes 55, permitting downward movement of the inner sleeve 21.

Applying a compressive force to inner sleeve 21 results in the travel stop 62 disengaging from the end 85. Continued downward movement will result in the indexing sleeve 29 abutting the shoulder 71, and result in the ratchet 69 engaging pawl 68 causing the travel stop 62 to rotate. At the end of the rotation, a tractive force is applied to the inner sleeve 21 such that it moves upwardly relative to inner sleeve 23. This will result in the troughs 81 of fingers 27*a* engaging the peaks 82 of fingers 28*a* so that the fingers are in opposed configuration, as best shown in FIG. 11*a*.

During the indexing process, the downward movement of inner sleeve 21 has resulted in the first inner portion 49 engaging intermediate sleeve 42 and moving downwardly to block the path between the inner passage 32 and nozzle assemblies 36 and close the flushing outlets 33.

Turning the pumps on and increasing the pressure in the passage 32 causes the locking mechanism 90 to move radially outward such that the locking head 57 engages slot 61*a* as shown in FIG. 13*b*, preventing further downward movement. The flushing device 20 is then in a closed condition as shown in FIG. 2.

Whilst the fluid is passing through the flushing device 20 the flushing outlets 33 cannot be open as upward movement is restricted due to fingers 28*a* and 27*a* being in opposed relation.

The switching between the two conditions of the flushing device 20 is controlled remotely by the operator on the surface. The operator will know to activate and deactivate the flushing device 20 according to the behaviour of the drilling stem assembly, the drilling head, and the slurry which is being returned to the surface.

The flushing device 20 is, in effect, a rigid member which can be loaded in either tension or compression, and its operational condition, that is the flushing outlet being open or closed, can only be changed by deliberate actions on the part of the operator. The relative movement of the inner sleeve 21 to the outer sleeve 23 is determined in the downward direction by annular shoulder 25 on the inner sleeve 21, abutting annular shoulder 26 on the outer sleeve 23, and in the upward direction by fingers 27*a* on the travel stop 62 and the fingers 28*a* located at the end of the fourth outer portion 152 of the outer sleeve 23.

The flushing device 20 may be placed anywhere along the drilling stem assembly below the neutral point, and its position will depend on the application. Indeed the drilling of a well may require the inclusion of one or more flushing devices 20 to be used to maintain the required conditions in the bore.

Where required the surface of the components are coated with a hard, wear resistant coating and ground to a fine finish in order to prevent scouring of the surface by the action of the drilling fluid. This also assists in prolonging the life of the seals.

The seals typically comprise an outer circular cross section elastomeric nitrile ring and an inner elastomeric urethane ring of typically trapezoidal cross section, working within a groove.

In alternative embodiments, the end 85 of the fourth outer portion 152, or the indexing sleeve 62 of the indexing mechanism, may have two or more slots or fingers side by side, such that the flushing device does not alternate from a closed to an open condition, but may, for instance, alternate between two open conditions and then one closed condition.

Modifications and variations such as would be apparent to the skilled addressee are considered to fall within the scope of the present invention.

Throughout the specification, unless the context requires otherwise, the word "comprise" or variations such as "comprises" or "comprising", will be understood to imply the inclusion of a stated integer or group of integers but not the exclusion of any other integer or group of integers.

The invention claimed is:

1. A flushing device for use in a drill assembly, the flushing device comprising:

an inner sleeve, axially slidable relative to an outer sleeve, the inner and outer sleeves cooperate to define an inner passage for the flow of a fluid, and are permanently coupled such that there is substantially no rotational movement between the two sleeves;

the inner passage having an inlet and an outlet;

the outer sleeve having a plurality of flushing outlets; and an indexing mechanism which indexes between a first position, wherein the plurality of flushing outlets are blocked from the internal passage such that the flushing device is in a closed condition, to a second position, wherein the plurality of flushing outlets register with the internal passage such that the flushing device is in an open condition, the indexing mechanism comprises a travel stop mounted on the inner sleeve for rotation about the longitudinal axis thereof, the travel stop has a second end adapted to engage and mesh a portion of the outer sleeve, wherein the second end of the travel stop is configured to provide a plurality of fingers and corresponding slots which co-act with corresponding fingers and slots integral with the portion of the outer sleeve, whereby the position of the fingers and slots of the travel stop relative to the fingers and slots of the portion of the outer sleeve will determine whether the flushing device is in an open or closed condition;

whereby when fluid flows through the flushing device, the flushing device is configured such that it remains in the selected open or closed condition regardless of the forces acting thereupon.

2. A device according to claim 1 whereby in use, the inner sleeve and outer sleeve are in mutual support and are positioned within the drill assembly.

3. A device according to claim 1 whereby in use, when there is substantially no fluid passing through the flushing device the inner sleeve and outer sleeve are axially movable through a limited predetermined length with respect to each other by remote regulation to open and close the flushing outlets.

4. A device according to claim 1 wherein the flushing outlets allow a predetermined percentage of the fluid to be diverted from the passage when the flushing device is in an open condition.

5. A device according to claim 1 wherein the indexing mechanism comprises an indexing sleeve.

6. A device according to claim 5 wherein the travel stop is adapted to co-operate with the indexing sleeve during the indexing sequence.

7. A device according to claim 5 wherein the indexing sleeve has a first end which provides a bottom face and a second end having a projection, defining a pawl, extending in an axial direction from the periphery of said second end.

8. A device according to claim 7 wherein the travel stop has a first end adapted to engage and mesh with the projection on the indexing sleeve.

9. A device according to claim 8 wherein the portion of the outer sleeve is shaped to engage and mesh with the second end of the travel stop.

10. A device according to claim 1 wherein the travel stop is constrained against relative movement along the longitudinal axis of the inner sleeve.

11. A device according to claim 1 wherein each finger and slot of the travel stop terminates in a depression or trough.

12. A device according to claim 1 wherein each finger and slot of the portion of the outer sleeve terminates in a peak.

13. A device according to claim 12 wherein each peak is complimentary in shape to a trough so that upon engagement each finger and slot on the travel stop mates with each finger and slot on the portion of the outer sleeve.

14. A device according to claim 13 wherein when the fingers are in opposed relation the flushing outlet is closed and the flushing device is in its closed condition.

15. A device according to claim 13 wherein when the fingers are in interlaced relation the flushing outlet is open and the flushing device is in its open condition.

16. A device according to claim 15 wherein the locking mechanism comprises a plurality of holes in the inner sleeve, and at least one locking member having a plunger adapted to be received in the holes.

17. A device according to claim 16 wherein the locking member is adapted to be received in a first or second groove on the inner face of the outer sleeve such that when in use, the pressure acting upon the plunger by the fluid flowing through the inner passage of the flushing device is to be greater than the biasing force exerted thereupon, resulting in the locking member being forced outward and engaging with the first or second groove, depending upon the condition of the flushing device.

18. A device according to claim 1 wherein during the indexing sequence, the fingers and slots on the travel stop are indexed from the first position, where the fingers mate in an opposed relation with the fingers on the portion of the outer sleeve, to the second position, where the fingers mate with the slots on the portion of the outer sleeve such that the fingers are interlaced with the fingers on the portion of the outer sleeve.

19. A device according to claim 1 wherein the flushing device comprises a locking mechanism which is capable of preventing substantial movement of the inner sleeve relative to the outer sleeve, and prevent the flushing device from unintentionally changing between open and closed conditions.

20. A device according to claim 19 wherein the locking member is constrained so as to only move in a radial direction.

21. A device according to claim 19 wherein a biasing means acts upon the locking member, biasing it inwardly.

22. A device according to claim 1 wherein the flushing outlet comprises a plurality of apertures in the inner sleeve, an annular chamber in the outer sleeve and a plurality of nozzles, forming a passage between the annular chamber and the outside of the flushing device.

23. A device according to claim 22 wherein each nozzle is shaped so as to direct fluid diverted from the inner passage backwards, away from the drill head.

24. A device according to claim 1 wherein the inner sleeve and outer sleeve define a cavity therebetween.

25. A device according to claim 24 wherein the cavity is filled with a lubricating fluid.

26. A device according to claim 24 wherein the indexing mechanism operates in the cavity.

27. A device according to claim 24 wherein the cavity is sealed from the passage such that no slurry can contaminate the cavity.

28. A device according to claim 24 wherein the flushing device also comprises means to balance and cushion the movement between the inner and outer sleeve.

29. A device according to claim 28 wherein the means to balance and cushion is in the form of a floating piston, equalising the pressure within the cavity.

30. A device according to claim 1 wherein the flushing device comprises an intermediate sleeve located between the inner and outer sleeve and is located between the flushing outlet and the outlet of the inner passage of the flushing device.

31. A device according to claim 30 wherein the intermediate sleeve creates a fluid tight seal between the inner and outer sleeve as the flushing device moves between the closed condition and the open condition.

32. A method of flushing an annular space between a drill stem and the wall of a bore using a flushing device incorporated in the drill stem comprising the steps of:

stopping the flow of a slurry through the flushing device, such that a locking mechanism is caused to be released, allowing axial movement of an inner sleeve relative to an outer sleeve of the flushing device;

applying a force upon the inner sleeve in a first axial direction to force a travel stop, constrained upon the inner sleeve and in engagement with a portion of the outer sleeve, to disengage from said portion and move towards an indexing sleeve, with continued application of the force causing a ratchet on the travel stop to engage a pawl on the indexing sleeve, forcing the travel stop to rotate until an indent on the travel stop mates with the pawl;

applying a further force to the inner sleeve in a second axial direction to cause the travel stop to disengage from the indexing sleeve and move toward the portion of the outer sleeve until the travel stop aligns and meshes with the portion of the outer sleeve in such a relationship that a plurality of flushing outlets register with the passage;

allowing the fluid to pass through the flushing device causing the locking mechanism to lock the inner sleeve to the outer sleeve, such that substantial downward movement of the inner sleeve relative to the outer sleeve in said first direction is prevented, wherein a percentage of the fluid is diverted from the passage to pass to the annular space through the flushing outlet to assist in cleaning the bore.

* * * * *

UNITED STATES PATENT AND TRADEMARK OFFICE

CERTIFICATE OF CORRECTION

PATENT NO. : 7,644,766 B2
APPLICATION NO. : 10/555367
DATED : January 12, 2010
INVENTOR(S) : Begley et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 733 days.

Signed and Sealed this

Sixteenth Day of November, 2010

David J. Kappos

David J. Kappos
*Director of the United States Patent and Trademark Office*